United States Patent [19]

Collins

[11] Patent Number: 4,586,117

[45] Date of Patent: Apr. 29, 1986

[54] AIR COOLED LIGHT

[75] Inventor: William J. Collins, Boulder, Colo.

[73] Assignee: Collins Dynamics, Inc., Aurora, Colo.

[21] Appl. No.: 694,290

[22] Filed: Jan. 24, 1985

Related U.S. Application Data

[62] Division of Ser. No. 404,333, Jul. 30, 1982, Pat. No. 4,502,103.

[51] Int. Cl.[4] ..... F21S 1/02; F21V 33/00

[52] U.S. Cl. ..... 362/373; 362/294; 362/199

[58] Field of Search ..... 362/199, 294, 373, 249

[56] References Cited

U.S. PATENT DOCUMENTS

| | | | |
|---|---|---|---|
| 2,178,897 | 11/1939 | Schellin | 362/373 |
| 2,611,072 | 9/1952 | Potekin | 362/199 |
| 2,921,182 | 1/1960 | Taylor | 362/199 |
| 3,502,858 | 3/1970 | Habro | 362/373 |
| 3,770,953 | 11/1973 | Riera | 362/373 |
| 3,831,021 | 8/1974 | Muhlogger | 362/294 |
| 4,039,817 | 8/1977 | Williams | 362/373 |
| 4,489,366 | 12/1984 | Roznieckl | 362/373 |
| 4,502,103 | 2/1985 | Collins | 362/226 |

*Primary Examiner*—Ronald B. Cox

*Attorney, Agent, or Firm*—Gregg I. Anderson

[57] ABSTRACT

A portable light including at least one lamp bulb, a battery and a control circuit for conducting electrical current from the battery to the lamp bulb comprising in combination:

an airflow passageway in which said battery, said control circuit, and said lamp bulb are serially mounted, said airflow passage defined at one end by an inlet in airflow communication with the atmosphere and defined at another end by an outlet in airflow communication with the atmosphere, and means for moving air between the inlet and outlet along said air passageway mounted in said air passageway and actuated by said control circuit.

6 Claims, 7 Drawing Figures

AIR COOLED LIGHT

CROSS REFERENCE TO RELATED APPLICATION

This application is a divisional application of copending application Ser. No. 404,333 now U.S. Pat. No. 4,502,103, filed July 30, 1982, for LIGHT WITH MOUNT FOR PLURAL LAMP BULBS.

BACKGROUND OF THE INVENTION

The invention relates generally to lights that have a dual function, operating as a flood light or as a spot light. One such Combined Flood and Spot Light is described in U.S. patent application Ser. No. 285,944, filed July 23, 1981, by the Applicant herein. More particularly, the invention relates to lamp bulb mounts, which support and align two lamp bulbs to achieve the dual function light. The invention also relates to lamp bulb sockets that are capable of accepting different types of lamp bulbs. The invention is particularly well suited for portable lights and driving lights.

Separate units for flood or fog lighting and for spot lighting have been available for many years. Campers, police officers and fire fighters have used separate units without great inconvenience. The separate units are hung from belts, and whichever unit is desired can be taken in hand when needed. However, it is apparent that a single unit having both capabilities would be highly desirable in any case and particularly so when the lights are mounted on motor vehicles where the space for attachment is more restricted as vehicles become smaller.

The present invention is particularly useful in association with a Combined Flood and Spot Light of the type described in Applicant's copending U.S. patent application Ser. No. 285,944, referenced above. Such a light, as described in the copending application, utilizes two bulbs in axial alignment with each other and positioned relative to each other and to a forwardly facing and a rearwardly reflecting reflecting member of the light. A mount that will align and position a pair of light bulbs, while maintaining easy access to both light bulbs for replacement, has not been previously available. Neither has there been available a mount for use with a light which was versatile enough to accept the different types of halogen lamp bulbs which are widely used in automobile driving lights and other high intensity requirements, such as police and fire work.

DESCRIPTION OF THE PRIOR ART

Combined flood and spot lights utilizing two distinct lamp bulbs as separate light sources in a single unit, are known. Dual lamp bulbs mounted within separate reflectors of a single driving light for automobiles are seen in U.S. Pat. Nos. 3,622,778 to T. Cibie and 3,870,876 to O. Puyplat. In both of these patent references, the lamp bulbs are offset with respect to a longitudinal axis of the light and to each other.

A pair of separate light bulbs that are mounted in an axial relationship to each other, along the longitudinal axis of a driving light of generally circular transverse cross section, are seen in A. Kush, U.S. Pat. No. 1,148,101 and A. Plewka, U.S. Pat. No. 3,759,084. Both Kush and Plewka rely on the concept of a pair of forwardly diverging and projecting reflective members or surfaces spaced along the longitudinal axis a slight distance away from each other. One of the lamp bulbs is mounted at each of the reflecting members at the rearmost concave position. Special provision must be made, as by removing one of the reflecting surfaces, in order to gain access to the rearwardmost lamp bulb for replacement.

Of particular interest in driving lights and portable lights, because of their relatively high intensity, are halogen lamp bulbs. Such lamp bulbs come in two main configurations. Axial filament halogen lamp bulbs, having wattages between fifty-five and eighty-six watts, are known as type H2. These axial filament lamp bulbs mount into a lamp socket through a pair of outwardly directed flange portions. A second type of halogen lamp features a filament transverse to a longitudinal axis of the lamp bulb. These transverse filament lamp bulbs are known by type T $2\frac{1}{2}$ or T $2\frac{3}{4}$ and have a wattage range of between six and fifty watts. A pair of twin leads or pins, parallel to a longitudinal axis of the lamp bulb, are the means through which connection to a lamp socket are made. No known devices possess the capability of connectably accepting, in a single socket, either the flange type or twin lead type of the halogen lamp bulbs.

It is known that to cool the lamp bulbs themselves can increase the endurance and the useable lifetime of the lamps. Increasing the endurance and useable lifetime of portable light units is particularly important because such units are usually employed in special or emergency situations where ultimate performance and longevity are required, or may even be critical.

OBJECTS AND SUMMARY OF THE INVENTION

It is the principal object of the present invention to provide a new and improved light that can function as a flood light or a spot light.

It is a related object of the present invention to provide a mount for a pair of axially aligned lamp bulbs of a light, which mount aligns and positions the lamp bulbs to advantageously achieve the desired flood and spot lighting functions.

It is a further related object of the invention to provide a lamp bulb support for axially aligned lamp bulbs that is easily removable from the light to replace either a forward or a rearwardly mounted lamp bulb.

It is another object of the present invention to provide a mount capable of accepting either or both of a flanged type or a twin pin type of a halogen lamp bulb.

It is still another object of the invention to provide a portable light powered by a rechargable battery and a control circuit in which the battery and control circuit are cooled to increase performance efficiency, prolong life and achieve reliability.

In accordance with these and other objects of the invention, a combination flood and spot light uses a pair of axially aligned lamp bulbs to function as a flood light or a spot light. A mount of the lamp bulbs aligns and positions the lamp bulbs relative to a forwardly directed reflecting member or surface of the light.

The lamp mount includes a generally cylindrical forward base with a forwardly divergent surface geometrically formed to matingly conform to the forwardly divergent reflecting member at a rearmost termination thereof. The forward base is releasably connected to a rearward base. The rearward base has a width approximately equal to that of the forward base and each base supports a lamp bulb of the light. The forward and rearward bases are received in a tubular support of the light. The lamp bulb of the rearward base projects through the forward base, while the lamp bulb of the forward base forwardly extend from the forward base a preselected distance. The preselected distances are established to achieve spot and flood reflection patterns from the reflecting member. The forward lamp bulb gives a spot light function to the light rays emanating therefrom, while the rearward bulb achieves the flood light function.

A socket adapted to receive either a flange type or a twin lead type halogen lamp bulb is connected both the forward and rearward bases. In order to achieve interchangeable acceptance, each of the sockets includes a pair of spring mounting means, each of which have the capability of accepting either type of halogen lamp bulb. Convenience is inherent because only one lamp bulb type may be available to a user. In an emergency situation, as may be encountered in police and rescue work, any bulb is better than none. Flexibility with respect to the flood and spot light configurations is available because the wattage specifications and light emission pattern will vary depending on the lamp bulb chosen.

The light includes a forwardly diverging housing into which the rear reflector member is mounted. Across the forwardmost termination of the housing a glass lens is secured. The housing is connected to the hollow tubular support, which support has fins formed on the outer surface thereof to effectuate cooling of the mount. The tubular support is connected to a handle of the light through a pivotal connection. The handle is hollow and, in turn, connects to a case. An outlet of the case registers with a fan driven by a motor which is contained within the case. Air moved by the fan enters an inlet of the case, moves past the battery and control circuit through the handle and pivotal connection into the tubular support, cooling the mount and lamp bulb, and exhausts through air holes in the housing.

Cooling of the entire light can increase endurance and therefore overall battery life, particularly a rechargable battery, since excess heat is deleterious to battery life. Maintaining a lower ambient temperature around the battery and control circuitry increases the efficiency and maximizes the lifetime of those components.

The invention is defined by the scope of the appended claims. A greater appreciation of the objects, improvements and features of the present invention can be obtained from the following detailed description and drawings.

DESCRIPTION OF THE PREFERRED EMBODIMENT

Figures 1, 3:
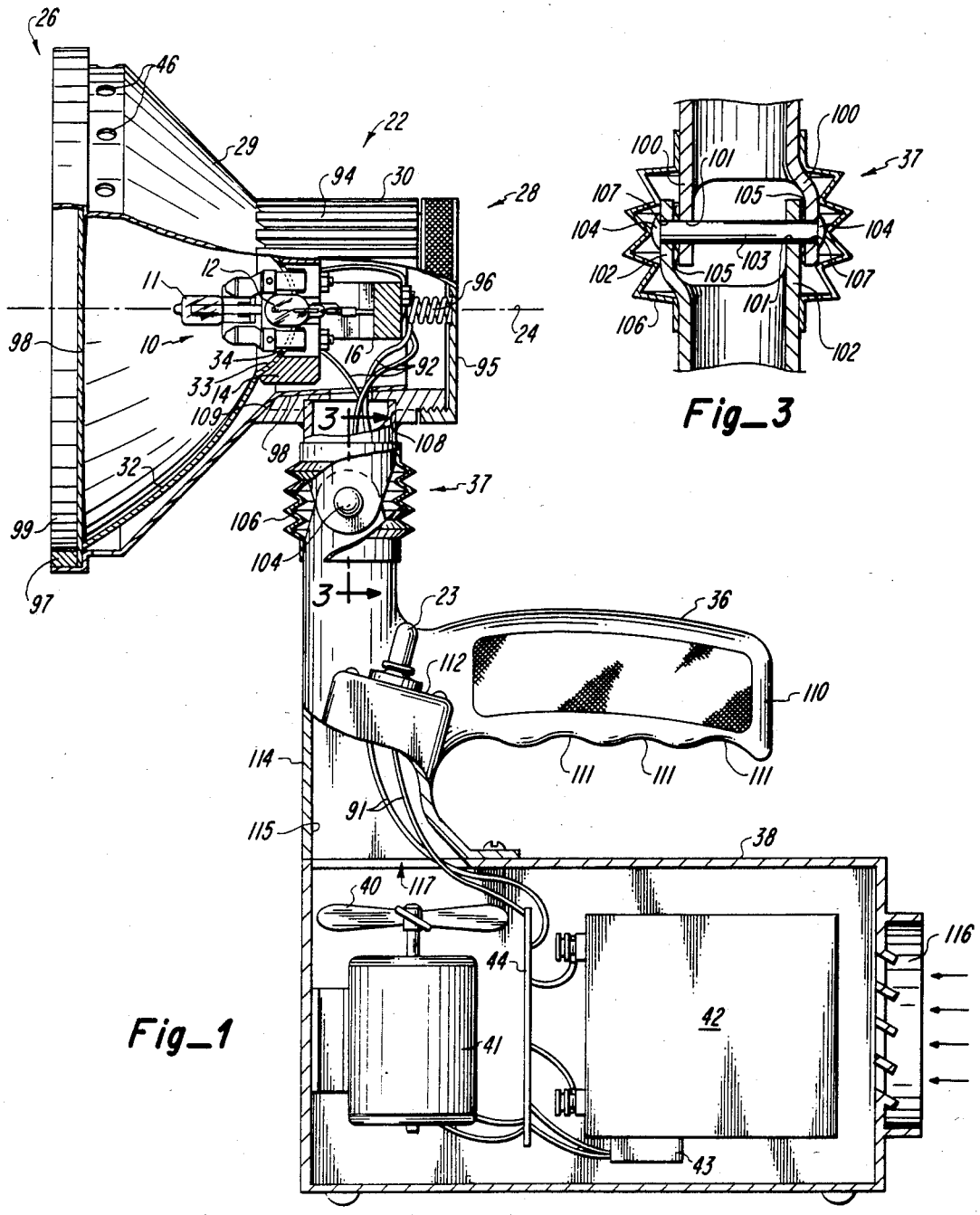
FIG. 1 is a side elevation view of a light of the invention secured to a handle and a case, certain portions of the light being broken away and shown as section views for clarity, wherein a motor, control circuit and rechargable battery are shown in diagrammatic form.
FIG. 3 is a sectional view taken in the plane of line 3—3 of FIG. 1.
Figure 2:
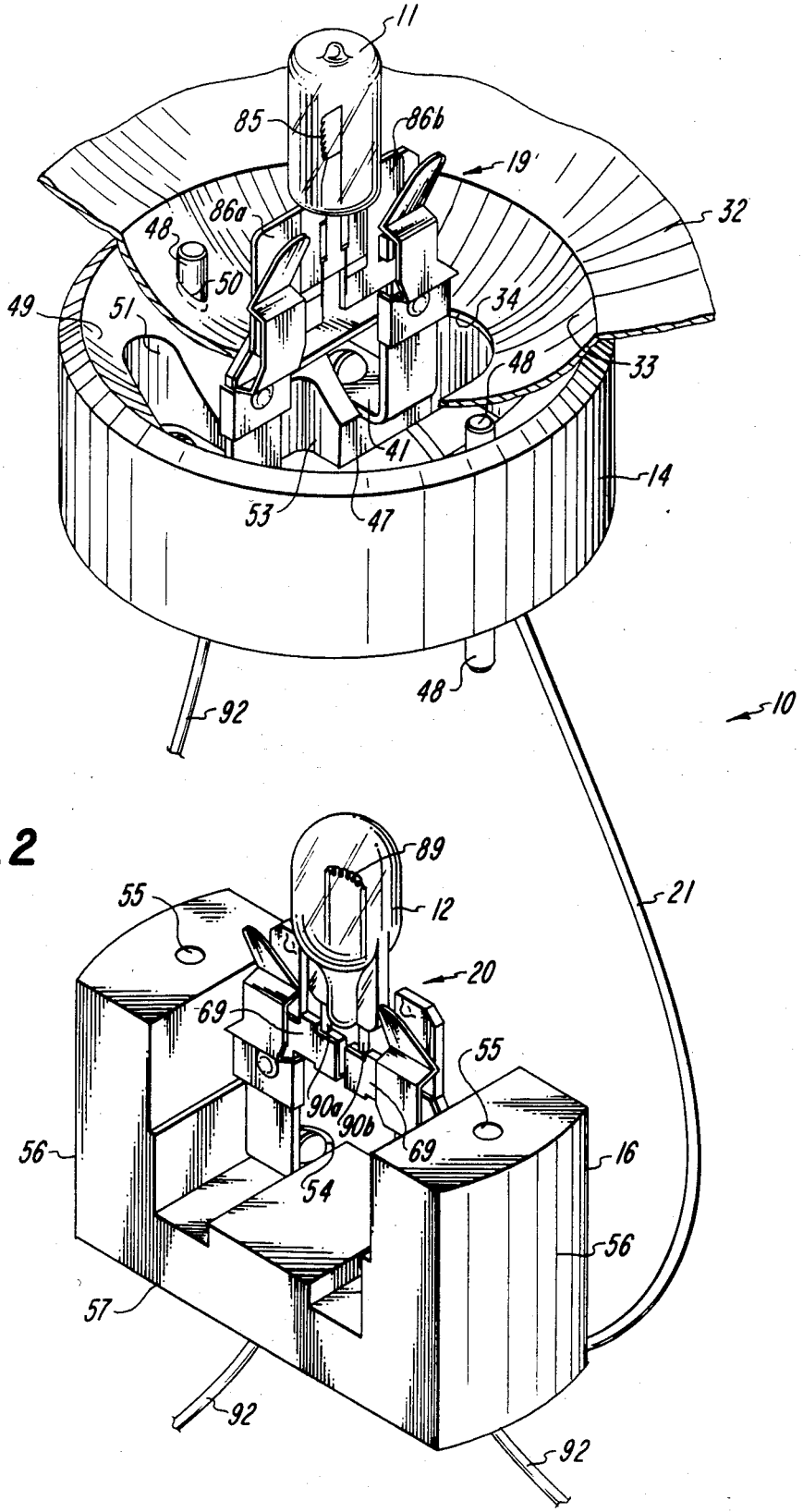
FIG. 2 is an exploded perspective view of a lamp mount and reflector of the invention, certain portions being broken away for clarity.
Figure 4:
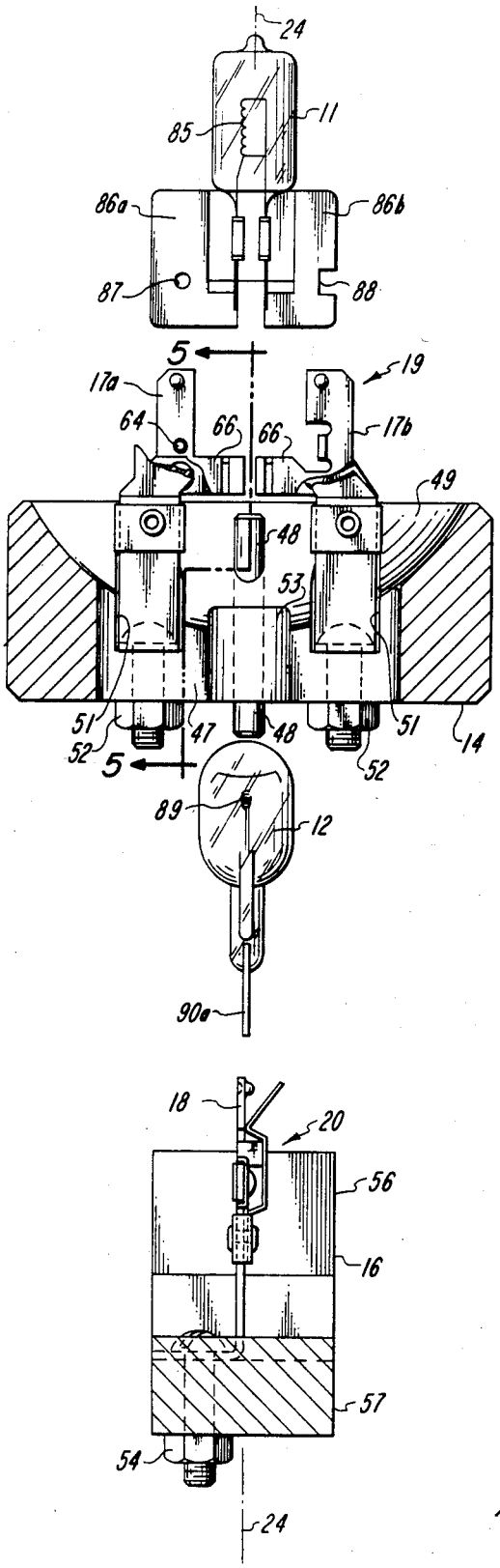
FIG. 4 is an exploded side elevation of the mount shown in FIG. 2, certain portions of the mount being removed for clarity and shown as section views.

A mount 10 for a pair of lamp bulbs 11 and 12 insertable into a multiple function light 22 is seen in FIGS. 1, 2 and 4. The mount 10 is insertable into the light 22 (FIG. 1) in a predetermined orientation so that the bulbs 11 and 12 are aligned along an axis 24, which axis is a longitudinal axis of the light 22.

The mount 10 is formed from two releasably connected pieces, a forward base 14 and rearward base 16. (FIGS. 2 and 4) A socket 19 of the forward base 14 accepts lamp bulbs having either the connection seen in lamp 11 or the connection seen in lamp 12. Similarly, a socket 20 of the rearward base 14 is adaptable for either type of lamp bulb 11 or 12.

The light 22 includes, at a forward end 26 thereof, an outwardly or forwardly divergent frustoconical housing 29 and at a rearward end 28 a hollow tubular support 30 within which the mount 10 is inserted from the rearward end 28. Hereinafter, reference will be made to forward and rearward in relation to the forward and rearward ends 26 and 28 of the assembled light 22, including the mount 10. The axis 24 is the longitudinal axis of the housing 29 and the tubular support 30, both the housing 29 and tubular support 30 presenting circular perpendicular cross sections relative to the axis 24. The housing 29 surrounds and retains therein a reflector member 32. The lamp bulbs 11 and 12 project through a central opening 34 in a concave recess 33 of the reflector member 32.

The relative dimensions and locations of the components of the light 22 with respect to each other are chosen so that light rays emanating from the forward lamp 11 will strike the forwardly divergent, preferably parabolic, reflector member 32 of the light 22, which reflector 32 will reflect the rays forwardly in a substantially parallel array, providing a spot light effect. The rearward lamp 12 is mounted in the concave recess 33 of the reflector 32 so that the light rays emitted are not focused by the parabolic reflector 32, instead travelling in a random array, providing a flood light effect. A double pole, double throw switch 23 is mounted on a handle 36 of the light 22 to separately actuate the forward lamp 11 or the rearward lamp 12.

A fan 40 is mounted within a case 38, which case is connected to the tubular support 30 by the handle 36 and a pivotal connection 37 (FIG. 3), and which fan 40 provides air movement means for cooling of the light 22. The fan is turned by a motor 41, the motor being actuated by a thermostat 43 connected to a battery 42, upon excess heat in the case 38. The battery 42 powers the lamp bulbs 11 and 12 and drives the motor 41. The battery is turned on by, switching takes place through, and the thermostat 43 is actuated through a control circuit 44.

The entire light 22 is maintained at an optimum temperature by air movement from the fan 41, which air movement passes by the battery 42, the control circuitry 44, the motor 41 and the lamp bulbs 11 and 12, before exiting or exhausting the light 22 through air holes 46 formed in the housing 29.

The forward base 14 of the mount 10 is of generally cylindrical shape (FIGS. 2 and 4). A slot or opening 47 is formed therethrough, which slot 47 is centered along the axis 24 when the forward base 14 is inserted into the tubular support 30. The opening 47 allows for passage of the rearward lamp bulb 12 through the forward base 14 and into a position between posts or terminals 17*a* and 17*b* of the socket 19 upon the connection of the rearward base 16 to the forward base 14 (FIG. 1).

To permit the connection between the rearward base 16 and the forward base 14 and to align the mount 10 with the reflector 32, the forward base 14 includes a pair of alignment pins 48 which project rearwardly and forwardly from the upper base 14 in parallel alignment with the axis 24, upon insertion of the forward base 14 into the tubular support 30. A forward surface 49 of the forward base 14 is forwardly concave or projecting. Upon insertion of the mount 10 into the tubular support 30, the surface 49 contacts and conformably mates to the concave recess 32, on the rearward side thereof in the area of the central opening 34. The alignment pins 48 pass through corresponding alignment holes 50 in the reflector 32 (FIG. 2).

A pair of contact notches 51 (FIG. 4) are formed in one half of the forward base 14, which branch to the side of the opening 47. The contact notch 51 allows for connection of the posts 17*a* and 17*b* to the forward base 14. A foot pad 41 (FIGS. 6, 7) of each of the posts 17*a* and 17*b* is threadably connected to the forward base 14 at the contact notch 51 by a nut and bolt, which defines a contact point 52. The contact point 52 is also connected to a like contact point 54 on the rearward base 16 by electrical conductors 21. (FIG. 2) A longitudinal groove 53 is formed in the forward base 14 between the contact notches 51. It is noted in FIG. 4 that the groove 53 is positioned ninety degrees away from a plane containing the posts 17*a* and 17*b*. This positioning of the groove 53 allows clearance of posts 18*a* and 18*b* of the rearward base 16 of the socket 20 as the rearward base is connected to the forward base 14. It is therefore seen that the mount 10, as assembled, includes the posts 17*a* and 17*b* containing the lamp bulb 11 and, in a plane perpendicular to the plane containing the posts 17*a* and 17*b*, the posts 18*a* and 18*b*.

The rearward base 16 (FIGS. 2 and 4) has a pair of alignment holes 55 formed along bores having axes parallel to the axis 24, the holes 55 therefore being provided to receive the alignment pins 48 of the forward base 14. The rearward base 16 is of a U-shaped configuration including parallel arms 56 and an interconnecting cross piece 57. The posts 18*a* and 18*b* are connected to the base 16 by the contact points 54, which are bolts with nuts threaded thereon, to the cross piece 57. The forward and rearward bases 14 and 16 are formed from injection molded high temperature plastic (polyphenylene sulfide) sold under the trademark RYTON (R4).

The posts or terminals 17*a* and 18*a* of the sockets 19 and 20 are substantially identical, as are posts 17*b* and 18*b*. (FIGS. 6 and 7) The following description will first focus on the guide posts 17*a* and 18*a*. Each guide post 17*a* and 18*a* includes the foot pad 41 (FIG. 5), which foot pad and contacts 52 and 54 are connected to the battery 42. Each guide post 17*a* and 18*a* also includes a rectangular upright 61 having a longitudinal axis parallel to the longitudinal axis 24, which upright 61 is of substantially rectangular plate construction. At the forwardmost terminal end of the guide posts 17*a* and 18*a* is located a small nipple 62. Intermediate the foot pad 41 and the small nipple 62, but nearer the small nipple 62 is a larger nipple 64. The nipples 62 and 64 are both integrally formed. An arm 66 extends laterally away from the upright 61 toward the opposite or alignment posts 17*b* and 18*b*. (FIG. 4) A small channel 67 is formed along an axis parallel to axis 24 near the distal end of the arm 66.

Figure 5:
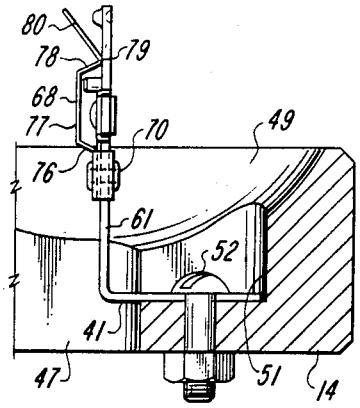
FIG. 5 is a section view taken in the plane of line 5—5 of FIG. 4.
Figure 6:
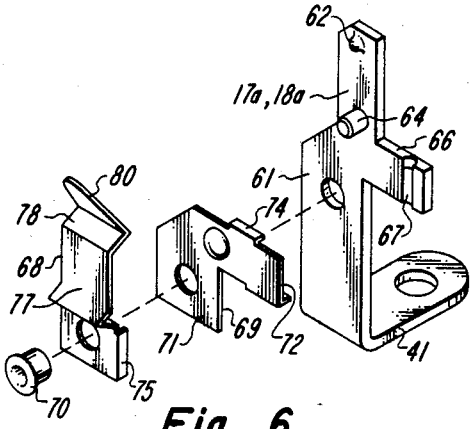
FIG. 6 is an exploded perspective view of one terminal of a socket of the mount seen in FIG. 2.
Figure 7:
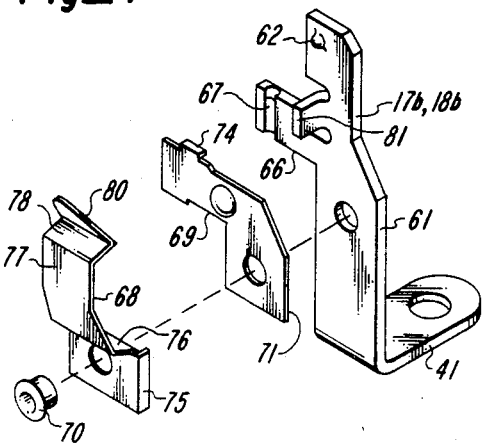
FIG. 7 is an exploded perspective view of another terminal of the socket of the mount seen in FIG. 2.

The posts 17*a* and 18*a* each include one upright 61, as well as a spring retainer 68 and spring plate 69 which are connected to the upright by a rivet 70. The spring plate 69 is of L-shaped configuration having a vertical leg 71 and a horizontal leg 72 (FIGS. 5 and 6). The vertical leg 71 is connected by the rivet 70 to the upright 61. The horizontal leg 72 extends laterally along and adjacent to the arm 66. A clasp 74 of the spring plate 69 secures the horizontal leg 72 to the arm 66.

The spring retainer 68 superimposes the spring plate 69 and includes a flat portion 75 through which the rivet 70 passes, connecting the spring retainer 68 to the upright 61. A step 76 (FIG. 5) raises a main body 77 of the spring retainer 68 to a slightly raised position relative to the vertical leg 71 of the spring plate 69. A second downward step 78 places the spring retainer 68 into contact with the upright 61 at 79 (FIG. 5). A thumb clip 80 angles away from the upright 61. The spring retainer 68 can be moved away from the upright 61 by pressure against the thumb clip 80.

The alignment posts 17*b* and 18*b* (FIG. 7) are of virtually identical construction to the guide posts 17*a* and 18*a* (FIG. 6). The same reference numbers have been incorporated in the drawing relating to posts 17*b* and 18*b*. The posts 17*a* and 17*b* and 18*a* and 18*b* are essentially mirror images of each other across a plane perpendicular to opposing post containing the axis 24. The alignment posts 17*b* and 18*b* have a tab 81 rather than the large nipple 69.

There are two types of lamp bulbs 11 and 12 to which the sockets 19 and 20 can adapt (FIGS. 3 and 4). Both the lamp bulbs 11 and 12 are halogen bulbs widely used in motor car applications and available from the North American Phillips Lighting Corporation of Hightstown, N.J. Referring to FIG. 4, the lamp bulb 11 is known as an H-2 type halogen lamp. It includes an axial filament 85 which is aligned along the axis 24. The lamp bulb 11 also includes a pair of laterally directed flanges 86*a* and 86*b*. The flange 86*a* includes a hole 87 formed therethrough which hole is received by the large nipple 64 of the guide posts 17*a* or 18*a*. The flange 86*b* includes a notch 88, which notch receives the tab 81 of the alignment posts 17*b* and 18*b*.

The lamp bulb 11 is fitted into one of the sockets 19 or 20 by actuation of the thumb clips 80 of the spring retainers 68, sliding the flanges 86*a* and 86*b* of the lamp bulb 11 downwardly until the hole 87 fits over the nipple 64 and the notch 88 fits over the tab 81. Releasing the thumb clips 80 applies a spring pressure against the flanges 86*a* and 86*b* holding the lamp bulb in place. The nipples 62 make the contact essentially a point contact between the nipples and the upright 61, increasing the frictional hold therebetween to secure the lamp bulb 11 into the socket 19 or 20.

The other type of lamp bulb 12 to which the sockets 19 and 20 are convertible is a halogen type T-2¾ bulb. The lamp bulb 12 has a filament 89 that is transverse to the axis 24 and a pair of twin leads 90*a* and 90*b* which connect to the sockets 19 and 20. The twin leads 90*a* and 90*b* are therefore fit into the lead receiving channels 67 and are retained therein by the spring plate 69. It is therefore seen that the lead receiving channels 67 are spaced a set distance apart corresponding to the manufactured distance between the leads 90*a* and 90*b*.

If the lamp bulb 11 is used, then the sockets 19 and 20 retain the lamp bulb through the spring retainer 68 in associated parts. If the lamp bulb 12 is used, then leads 90*a* and 90*b* are received in the lead receiving channel 67 and held in place by the spring plates 69.

Electrical current to operate the lamp bulbs 11 and 12 is supplied by the battery 42, which battery is a nickel cadmium rechargeable type supplying approximately 13.2 volts. Current is supplied through the control circuit 44 and electrical conductors 91 to the toggle switch 23, three electrical conductors 92 pass through the pivotal connection 37, one common ground and two positive conductors, the positive conductors attaching to one of the contacts 52 and 54, the other contacts 52 and 54 attaching to the common ground, which contacts are in electrical contact with the lamp bulbs 11 and 12. The rear base 16 is seen to be automatically aligned to a position allowing the conductors 92 to enter the interior of the tubular support 30 (FIG. 1). In a conventionally wired manner, the toggle switch 23 completes a circuit including either lamp 12 or lamp 11, giving either a flood or a spot light effect.

The entire mount 10 is received in axial alignment with axis 24 by the tubular support 30, which support 30 also acts as a heat sink. The tubular support 30 is of cylindrical construction having axial fins 94, for radiating heat, formed along the outer surface, and a hollow interior opening dimensioned so as to matingly receive the forward base and rearward base 14 and 16 in free sliding contact. Once the mount 10 is inserted into the tubular support 30, a threaded end cap 95 having an axial spring 96 is connected to the tubular support 30 at the rearward end 28. An elongated opening 108 (not specifically shown) allows for connection to the pivotal connection 37 and for passage of air into the tubular support 30.

The frustoconical shaped housing 29 (FIG. 1) is press fitted into the forward end 26 of the tubular support 30 through a tapered opening 109. The housing 29 surrounds the reflector member 32 and has a retainer ring 97 essentially coterminous with the associated free edge of the reflector member 32. An open tapered portion 98 matingly fits within the tapered opening 109 of the tubular support 30 and are secured together by any suitable means such as soddering, braising, welding or the like. The lamp bulbs 11 and 12 extend through the central opening 34 and opening 98 in the reflector member and housing 29, respectively, to a preselected distance forward of the central opening 34.

A circular transparent glass plate or lens 98 extends across the open ends of the first reflector member 32. A circular rim or frame 99 serves as a closure for the light 22 and holds the housing 29, reflector member 32 and lens 98 in fixed relationship to each other at the edge 97.

An integral support U-joint 100 (FIG. 3) is press fit and spot welded to tubular support 30 in the opening 105 and forms a portion of the pivotal connection 37. The U-joint 100 is hollow, allowing for passage of conductors 92, as well as the passage of air. Holes 101 are formed therethrough to receive a pin 103 for pivotal connection to ears 102 of the handle 36, through like holes 107 in the ears 102. Ends 104 of the pin are splayed to define rivet-like connections. The U-joint 100 connects in an offset manner to the same side of each ear 102. Wave washers 105 of circular plan view are interposed between each ear 102 and the U-joint 100, providing a spring biased force that will retain the housing 29 and tubular support 30 in a set position relative to the case 38. A rubber boot 106 covers the entire pivotal connection to both seal against air flow when the light 22 is being cooled, as well as to prevent catching a finger or piece of clothing in the connection 37 and to waterproof the light 22.

The handle 36 includes a grip 110 having finger indentations 111 formed therealong. A panel 112 allows for monitoring of the condition of the battery 42, and through control circuitry not specifically shown, and is the location of the switch 23. A generally hollow frustoconical portion 114 extends from the grip 110 to connect to the case 38 in a conventional manner, as by screws. A passage 115 is formed through the frustoconical portion 114 through the handle 36 to the pivotal connection 37.

The case 38 includes an open inlet 116 and outlet 117. Ambient air is brought into the inlet 116 past the battery 42, control circuit 44 and motor 41 by the fan 40. The fan 40 is positioned in the outlet 116 to force air into the passage 115.

Air cooling of the light 24 is thus provided by the movement of air by the fan 40 from the inlet 116, through the outlet 117, down the passage 115, through the opening 105. The entire mount 10 is therefore air cooled upon excessive heat occurring at the thermostat 43. The mount 10 allows air to pass into the interior of the housing 29 and in the area between the reflector member 32 and housing. Air finally exhausts the light 22 through the air holes 46.

Although the present invention has been described with a certain degree of particularity, it is understood that the present disclosure has been made by way of example and that changes in details and structure may be made without departing from the spirit thereof.

What is claimed is:

1. A portable light including at least one lamp bulb, a battery and a control circuit for conducting electrical current from the battery to the lamp bulb comprising in combination:

an airflow passageway in which said battery, said control circuit, and said lamp bulb are serially mounted, said airflow passage defined at one end by an inlet in airflow communucation with the atmosphere and defined at another end by an outlet in airflow communication with the atmosphere, and means for moving air between the inlet and outlet along said air passageway mounted in said air passageway and actuated by said control circuit.

2. The invention as defined in claim 1 wherein said air moving means comprises a fan.

3. The invention as defined in claim 1 wherein said light includes a case, said battery and said control circuit mounted within said case, said inlet is formed in said case and a handle interconnects said case to a housing to which said lamp bulb is secured, said air passage extending along said case, through said handle and said housing.

4. The invention as defined in claim 3 wherein said housing is pivotally connected to said handle, said air passage defined at said pivotal connection by flexible tubular means connected to said handle and to said housing.

5. An air-cooled light having at least one lamp bulb, a forwardly diverging housing of said light having a reflector member connected thereto, said housing connected to a tubular support within which said lamp bulb is mounted, said light further including a rechargable battery electrically connected to said lamp bulb through an electrical control circuit comprising in combination:

a case operably connected to said housing into which said battery and said control circuit are mounted, said case having an open inlet at one end thereof and an open outlet at another end thereof;

air flow generation means for moving air from said inlet of said carrying case to the outlet of said carrying case being mounted within said carrying case;

a handle fixedly connected to said case across said outlet and pivotally connected to one of said housing or said support, said handle having an air passage from said outlet of said carrying case to said housing and support; and exhaust means for permitting the flow of air from said air passage of said handle through said housing and support and by said lamp bulb.

6. The invention as defined in claim 5 wherein said light is further cooled by fins formed on said tubular support to radiate heat therefrom.

* * * * *